US006499575B1

(12) United States Patent
Tsai

(10) Patent No.: US 6,499,575 B1
(45) Date of Patent: Dec. 31, 2002

(54) WHEELED LUGGAGE

(76) Inventor: James Tsai, No. 103, Ta-Ming Rd., Tung Pao Village, Tan Tzu Hsian, Taichung Hsien (TW)

( * ) Notice: Subject to any disclaimer, the term of this patent is extended or adjusted under 35 U.S.C. 154(b) by 0 days.

(21) Appl. No.: 09/931,031

(22) Filed: Aug. 17, 2001

(51) Int. Cl.[7] ..... A45C 13/00; A45C 5/00

(52) U.S. Cl. ..... 190/107; 190/115; 190/18 A; 190/903; 150/107; 383/907

(58) Field of Search ..... 190/107, 115, 190/18 A, 903, 113; 150/107; 383/907

(56) References Cited

U.S. PATENT DOCUMENTS 4,703,519 A * 10/1987 Krenzel ..... 190/115 X
4,848,782 A * 7/1989 Schmidt ..... 190/18 A X
5,588,569 A * 12/1996 Mitomi et al. ..... 190/18 A X
5,755,311 A * 5/1998 Younessian et al. ..... 190/114
5,855,766 A * 1/1999 Mamiye et al. ..... 206/581
6,279,706 B1 * 8/2001 Mao ..... 190/115
6,318,552 B1 * 11/2001 Godshaw ..... 190/127 X
6,357,567 B1 * 3/2002 Tsai ..... 190/115 X

* cited by examiner

*Primary Examiner*—Lee Young
*Assistant Examiner*—Tri M. Mai
(74) *Attorney, Agent, or Firm*—Browdy and Neimark, P.L.L.C.

(57) ABSTRACT

A wheeled luggage comprises a main frame body formed of a fixed shell and a movable shell which is pivoted at one end to one end of the fixed shell. Two elastic side shells are respectively disposed in two sides of the main frame body, so as to form a receiving space by the main frame body and the two side shells for holding articles. Two zippers are disposed at the juncture at the movable shell, two side shells, and the fixed shell. The articles are deposited in the receiving space or removed from the receiving space by opening the movable shell. A retractable handle is disposed in the top of the fixed shell. Two wheels are pivoted to the bottom of the fixed shell of the main frame body.

10 Claims, 9 Drawing Sheets

WHEELED LUGGAGE

FIELD OF THE INVENTION

The present invention relates generally to a luggage, and more particularly to a novel wheeled luggage.

BACKGROUND OF THE INVENTION

As shown in FIG. 1, a prior art wheeled luggage 70 comprises a rectangular shell 71, which is the main structure shaping the prior art wheeled luggage 70. The shell 71 is covered by a soft fabric for forming an outer side wall 72 and an inner side wall 73 of the wheeled luggage 70, thereby resulting in formation of a receiving space 74 in the interior of the wheeled luggage 70. The receiving space 74 is intended to hold articles, clothes, etc. The outer side wall 72 is provided with a zipper 721 by means of which the receiving space 74 is opened or closed. The wheeled luggage is provided at the bottom with two wheel 75, and at the center of the top with a handle 76 to facilitate the carrying of the wheeled luggage 70. The inner side wall 73 is provided in the inner side with an expandable pull rod 77 which can be extended out to facilitate the pulling of the wheeled luggage 70 on a surface.

The outer side wall 72 is made of a soft fabric material and is therefore incapable of protecting the articles contained in the wheeled luggage 70 against the damage that is often caused by an unexpected external force. In addition, the monotonous structural design of the prior art wheeled luggage 70 is unable to catch the fancy of the consumers.

SUMMARY OF THE INVENTION

It is the primary objective of the present invention to provide a novel wheeled luggage.

It is another objective of the present invention to provide a novel wheeled luggage capable of protecting the articles contained in the wheeled luggage against damage.

In keeping with the principle of the present invention, the foregoing objectives of the present invention are attained by a wheeled luggage comprising an annular main frame body formed of a fixed shell and a movable shell which is fastened pivotally at one end thereof with the fixed shell such that other end of the movable shell is detachably fastened with the fixed shell. Two elastic side shells are disposed at two openings of the main frame body such that a receiving space is formed by the main frame body and the two side shells for holding articles which can be removed therefrom by opening the movable shell. The fixed shell is provided on the top side with a retractable handle, and at the bottom side with two wheels pivoted thereto.

DETAILED DESCRIPTION OF THE INVENTION

Figure 1:
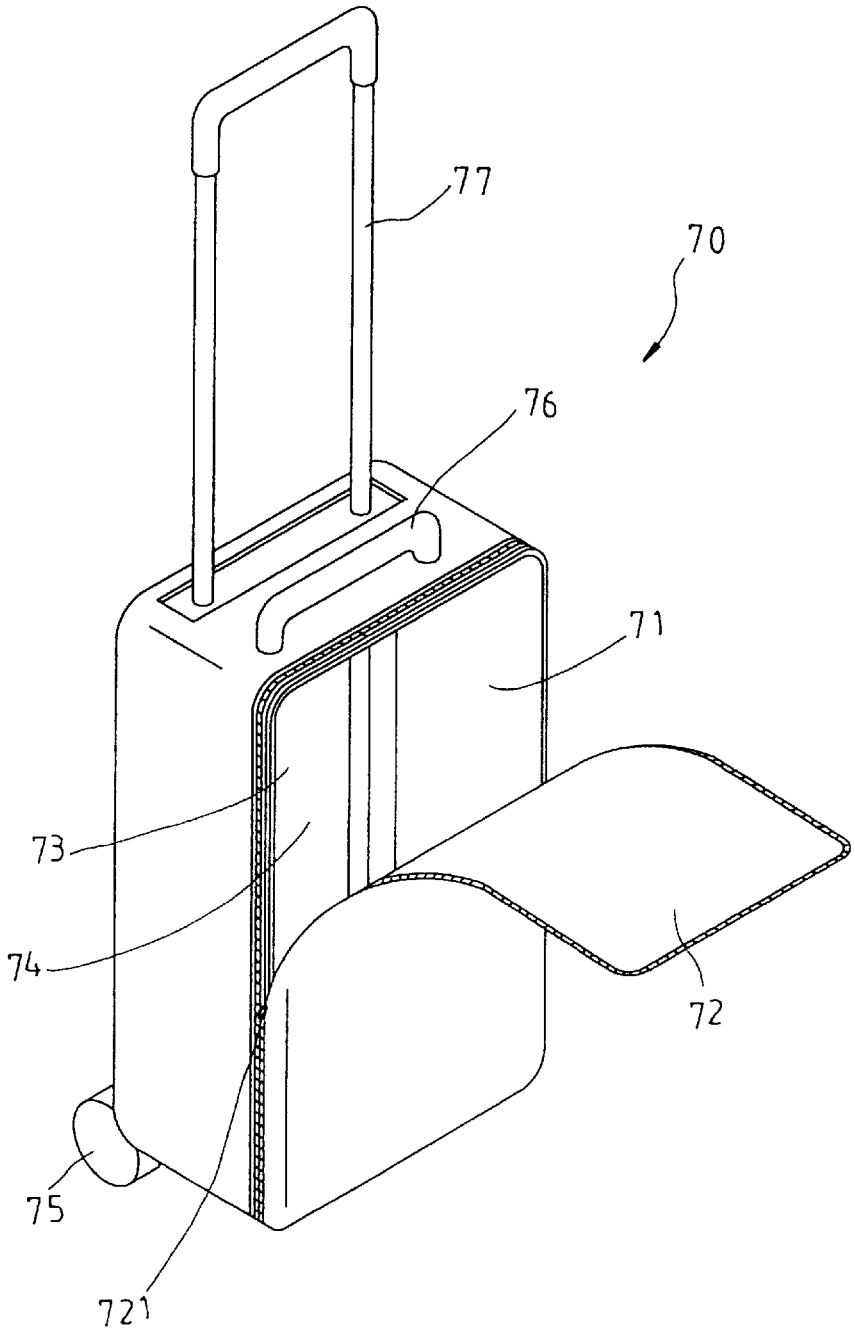
FIG 1 PRIOR ART
FIG. 1 shows a schematic view of a prior art wheeled luggage.
Figure 2:
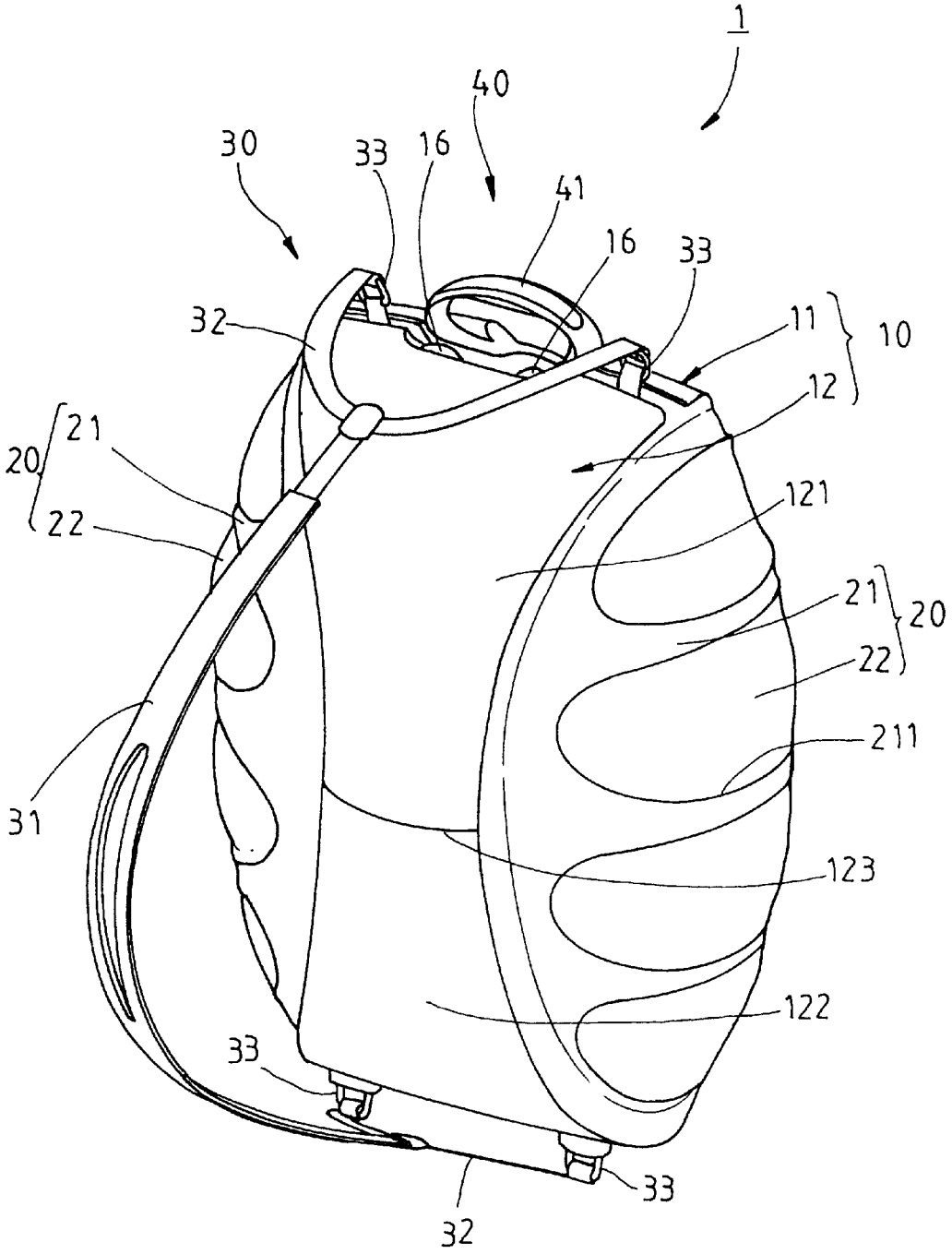
FIG. 2 shows an external view of a first preferred embodiment of the present invention.
Figure 3:
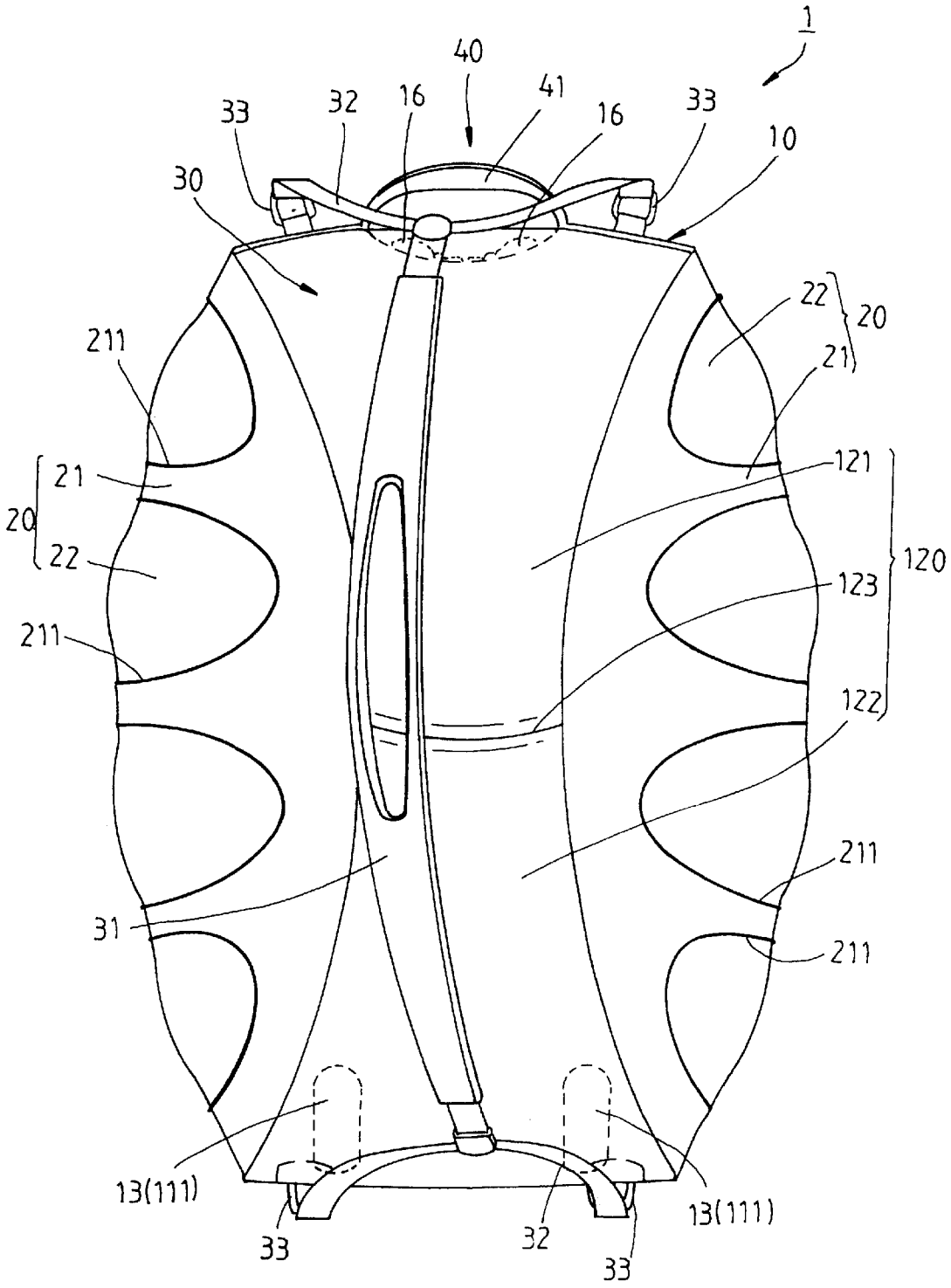
FIG. 3 shows a front view of the first preferred embodiment of the present invention.

As shown in FIGS. 2–5, a wheeled luggage embodied in the present invention comprises a main frame body 10, two side shell bodies 20, a retractable handle 30, and a carrying belt 40.

The main frame body 10 is of an annular plate body and is formed of a fixed shell 11 and a movable shell 12. The fixed shell 11 is a long plate body made of a composite material of carbon fiber or glass fiber. The fixed shell 11 has a midsegment and two ends which are greater in width than the midsegment. The fixed shell 11 has an arcuate shape and two recessed cells 111 which are located in the bottom for pivoting two wheels 13. The fixed shell 11 is provided in the inner side with a slot seat 15 whose function will be described later.

The movable shell 12 is a long plate body made of a carbon fiber composite material or glass fiber composite material. The movable shell 12 has a first shell piece 121 and a second shell piece 122, which are made integrally such that a juncture thereof is provided with a bending portion 123 enabling the two shell pieces 121 and 122 to turn in relation to each other in a predetermined angular range. The bottom of the movable shell 12 is corresponding to the bottom of the second shell piece 122 and is pivotally fastened with the bottom of the fixed shell 11. The top of the movable shell 12 is corresponding to the top of the first shell piece 121 and is detachably fastened with the fixed shell 11, thereby enabling the fixed shell 11 and the movable shell 12 to have an annular shape.

The first shell piece 121 and the second shell piece 122 of the movable shell 12 may be two independent elements, which are pivotally fastened together.

The two side shells 20 comprise a shell piece body 21 and a cloth body 22. The shell piece body 21 is an arcuate piece made of an elastic plastic material and having four openings 211. The cloth body 22 is attached to the inner side of the shell piece body 21 such that the cloth body 22 is partially exposed via the openings 211 of the shell piece body 21. The two shell piece bodies 21 are disposed respectively at two annular openings of the main frame body 10 such that the portions of the end edges of the two shell piece bodies 21 are fastened with the corresponding end edges of the fixed shell 11, and that other portions of the end edges are detachably fastened with the movable shell 12. As a result, a receiving space 100 is formed and defined by the fixed shell 11, the movable shell 12, and the two side shells 20. The articles are held in or removed from the receiving space 100 by opening the movable shell 12.

Figure 6:
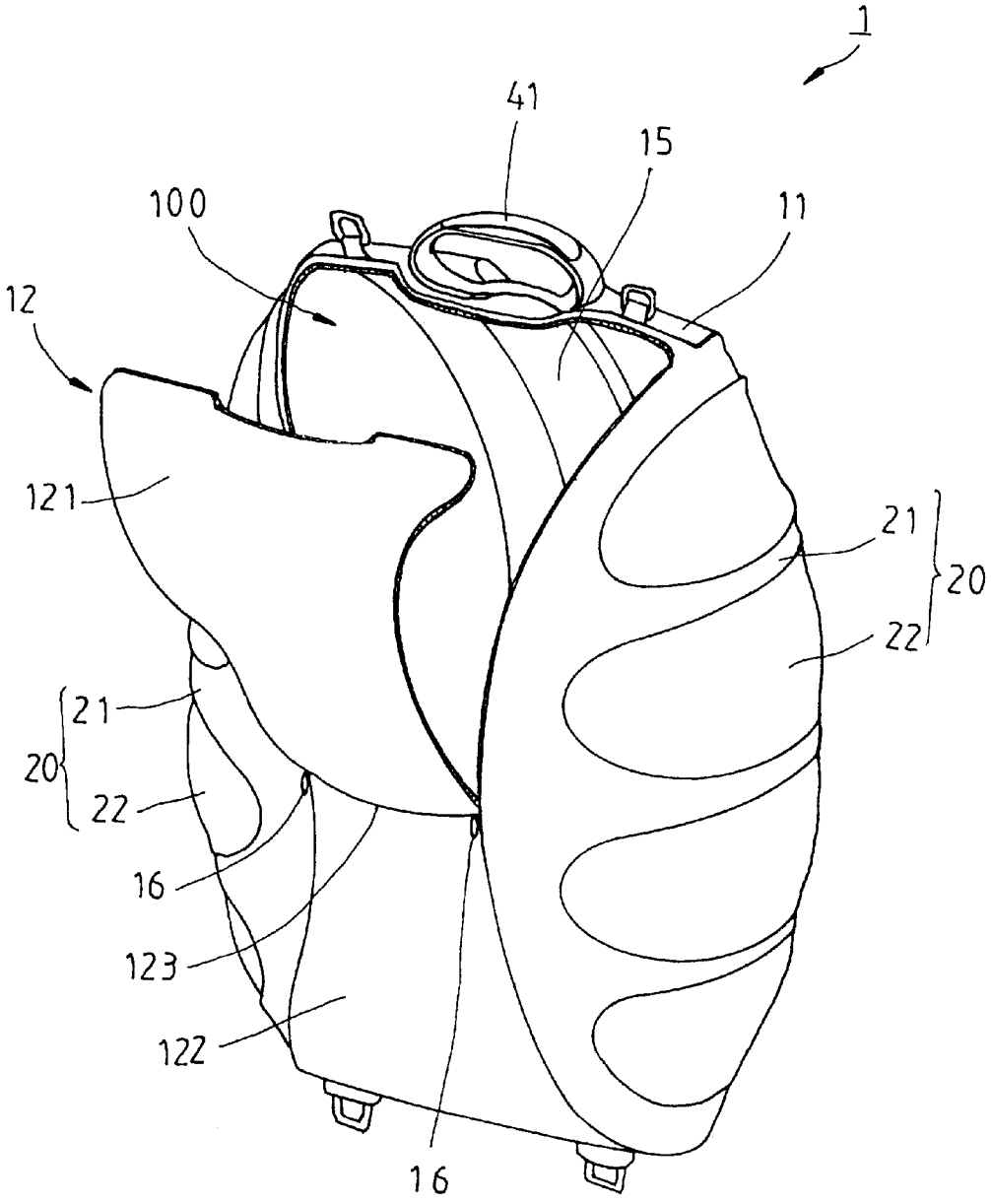
FIG. 6 shows an external view of the first preferred embodiment of the present invention with its first shell piece being opened.

The movable shell 12, the two side shells 20, and the fixed shell 11 have a juncture which is provided with two zippers 16. As the zippers 16 are opened to arrive at the bending portion 123 of the movable shell 12, the first shell piece 121 can be rotated on the bending portion 123 serving as a rotating center, so as to facilitate the depositing or the removing of an article via a smaller opening of the receiving space 100, as illustrated in FIG. 6.

Figure 7:
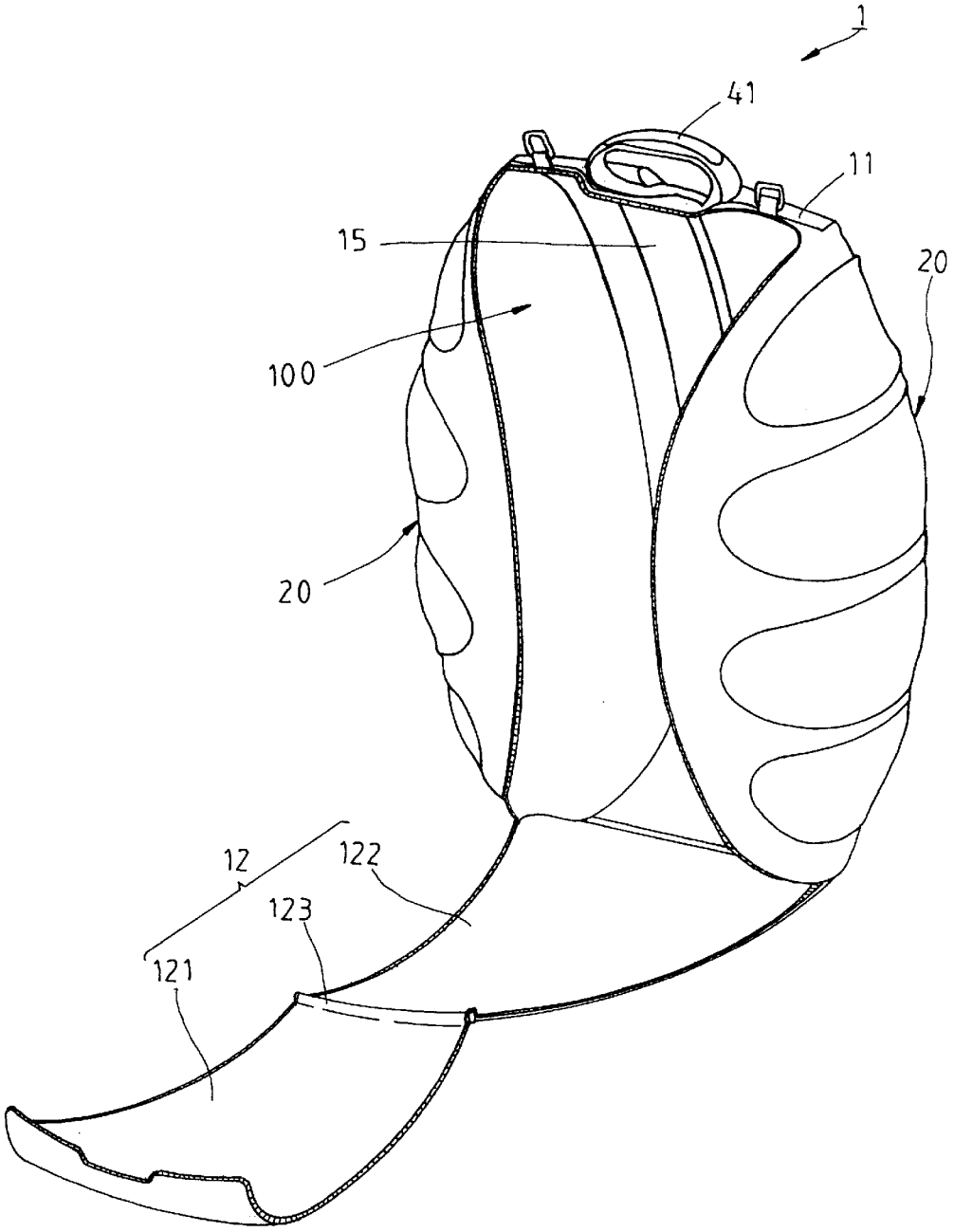
FIG. 7 shows an external view of the first preferred embodiment of the present invention with its first shell piece and second shell pieces being opened.

As illustrated in FIG. 7, the two zippers 16 are pulled down to arrive at the bottommost end to facilitate the depositing or the removing of an article having a greater volume. In the meantime, with the pivoting portion of the movable shell 12 and the fixed shell 11 serving as a rotating center, the first shell piece 121 and the second shell piece 122 of the movable shell 12 can be opened simultaneously to place or remove the large article.

In light of the two side shells 20 being made of an elastic material, the two side shells 20 can be pulled outwards to enlarge the opening of the wheeled luggage in the wake of the opening of the movable shell 12.

The carrying belt 30 comprises a main strap body 31, two connection belts 32, and four retaining seats 33. Two of the four retaining seats 33 are disposed at the top side of the fixed shell 11, whereas other two retaining seats 33 are disposed at the bottom side of the movable shell 12. Both ends of the two connection belts 32 are disposed on the two retaining seats 33 which are located on the same side. The main strap body 31 is pivoted at both ends with the two connection belts 32.

Figure 8:
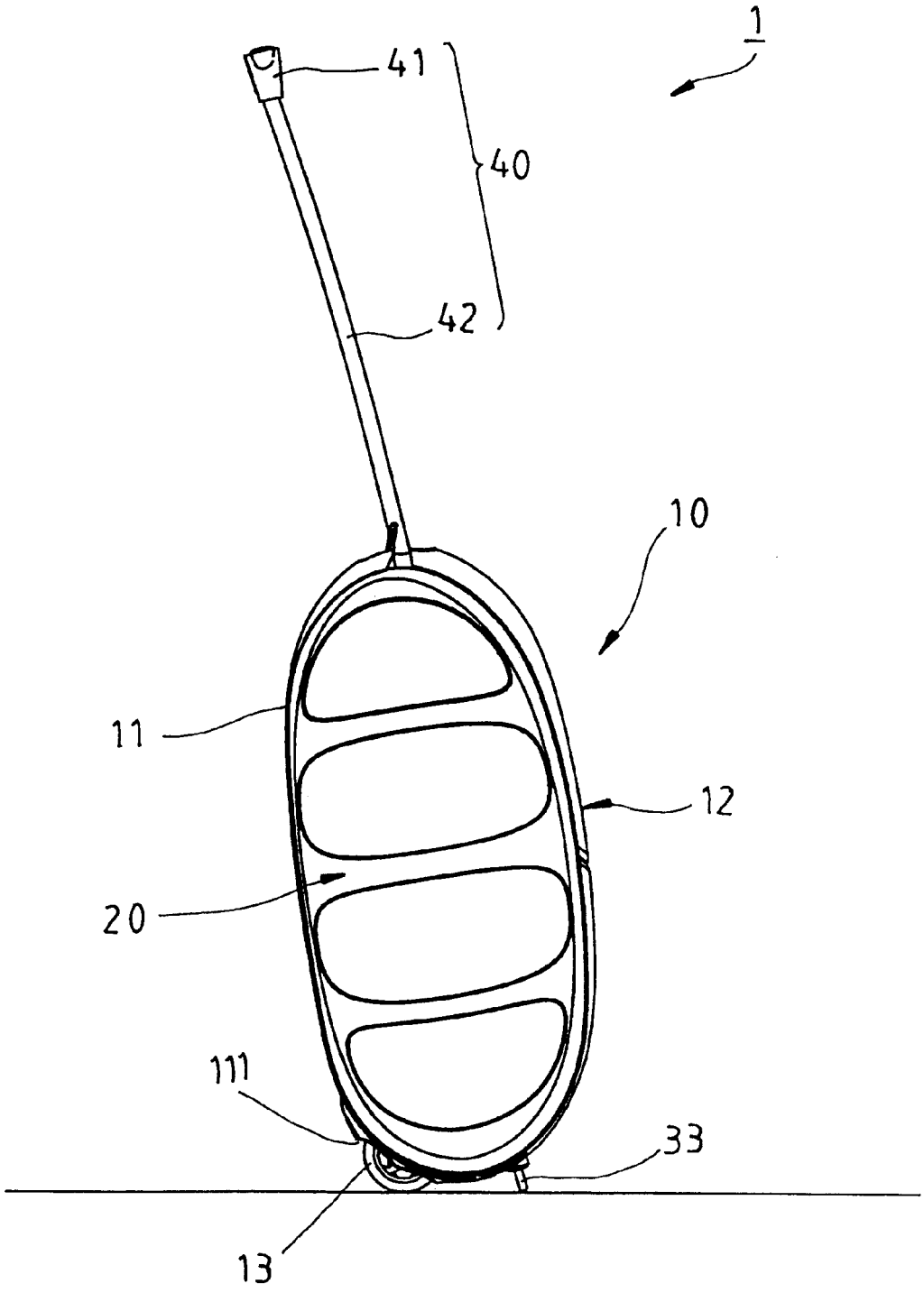
FIG. 8 shows a side schematic view of the first preferred embodiment of the present invention with its retractable handle being extended.

Those two retaining seats 33 which are located in the bottom side may be used as two support feet of the wheeled luggage. As shown in FIG. 8, the wheeled luggage of the present invention is rested on a surface on the two retaining seats 33 and the two wheels 13, which serve as points of support.

Figure 4:
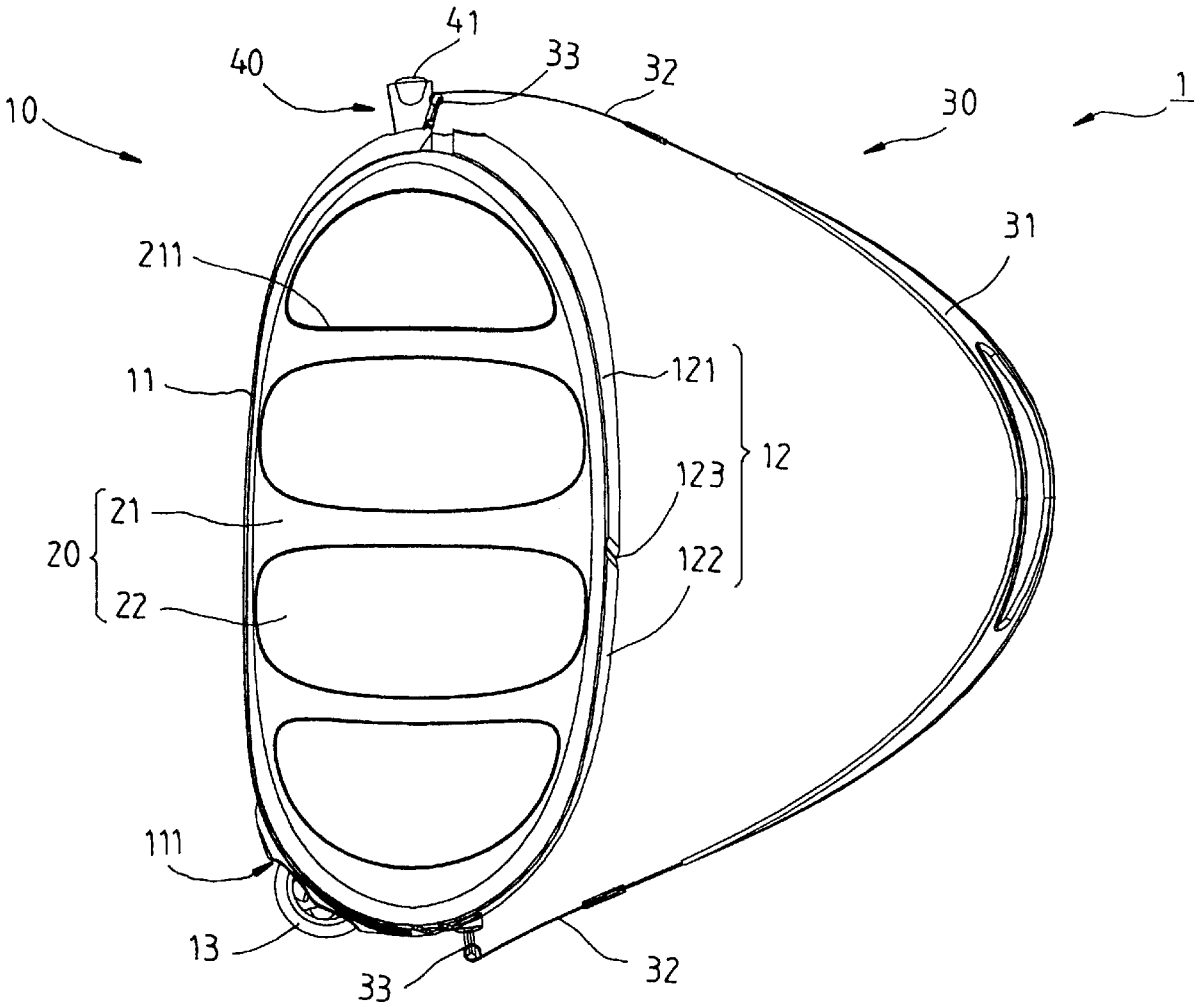
FIG. 4 shows a side view of the first preferred embodiment of the present invention.
Figure 5:
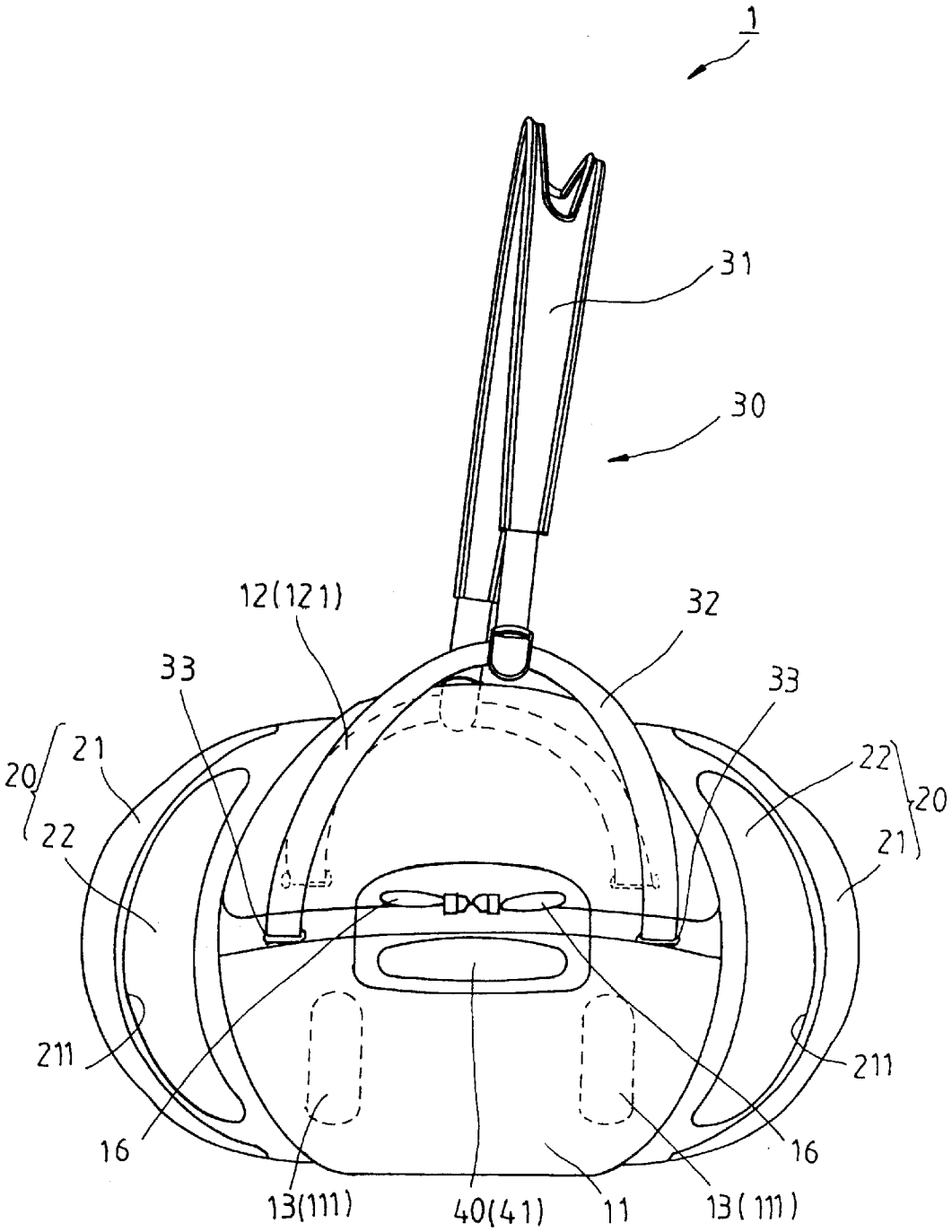
FIG. 5 shows a top view of the first preferred embodiment of the present invention.

As shown in FIG. 8, the retractable handle 40 comprises an expandable member 41 and a handlebar 42 which is disposed at the outer end of the expandable member 41. The expandable member 41 is an elastic long strip body which is made of a carbon fiber material or a glass fiber material. The expandable member 41 is pivoted in the slot seat 15 of the fixed shell 11. The handlebar 42 is located in the outside of the fixed shell 11 such that the handlebar 42 can be folded inwards, as shown in FIG. 4, or extended outwards, as shown in FIG. 8.

The retractable handle 40 is provided with a locating mechanism (not shown in the drawings) for locating the handlebar 42 after the handlebar 42 is folded or extended. The locating mechanism is not the subject matter of the present invention.

Figure 9:
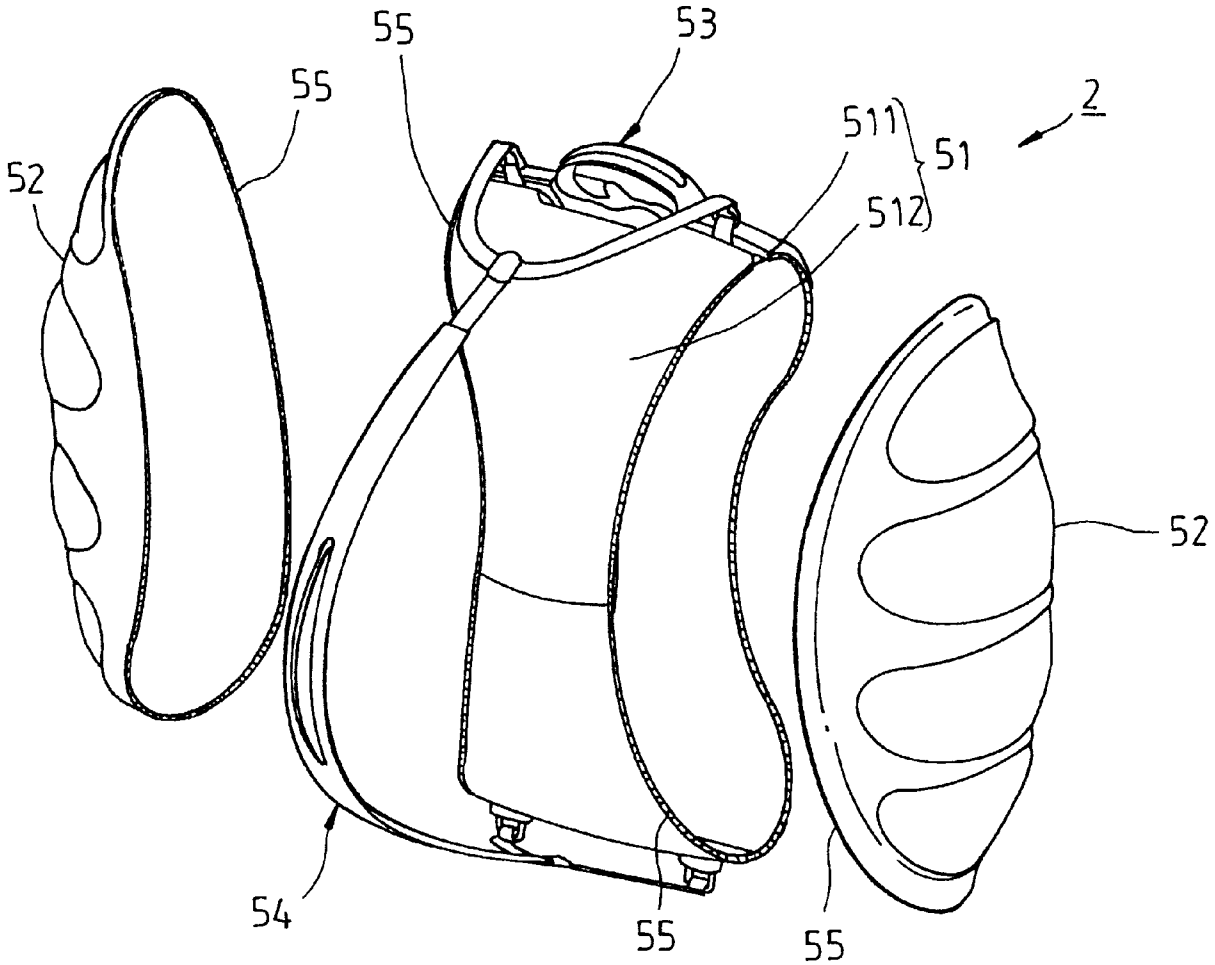
FIG. 9 shows a schematic view of a second preferred embodiment of the present invention.

As shown in FIG. 9, a wheeled luggage of the second preferred embodiment of the present invention is basically similar in construction to that of the first preferred embodiment of the present invention and is formed of a main frame body 51 having a fixed shell 511 and a movable shell 512, two side shells 52, a retractable handle 53, a carrying belt 54, and two wheels (not shown in the drawing). The difference between the first and the second preferred embodiments is that the juncture of the two side shells 52 and the main frame body 51 is provided with a zipper 55 enabling the two side shells 52 to be detachably joined together. The second preferred embodiment of the present invention provides the consumer with two replaceable side shells 52.

The present invention is characterized by the rigid main frame body 10, 51 which is the main structural framework of the wheeled luggage, the movable shell 12, 512 which is used to open the wheeled luggage, and the two elastic side shells 20, 52 which enable the wheeled luggage of the present invention to have a novel appearance.

It is therefore readily apparent that the wheeled luggage of the present has several advantages over the prior art wheeled luggage. In the first place, the rigid movable shell 12, 512 of the main frame body 10, 51 of the present invention provides protection against damage to the articles which are contained in the wheeled luggage. In addition, the movable shell 12, 512 of the present invention can be opened in two steps to facilitate the depositing or the removing of articles of different sizes. The wheeled luggage of the present invention can be carried in various ways by means of the carrying belt 30, 54, the retractable handle 40, 53. Moreover, the wheeled luggage of the present invention is provided with two replaceable side shells 52 which enhance the marketability of the wheeled luggage of the present invention.

What is claimed is:

1. A wheeled luggage comprising:

an annular and rigid main frame body formed of a fixed shell and a movable shell which has one end pivoted with said fixed shell and the other end detachably fastened with said fixed shell;

two elastic side shells disposed respectively on two sides of said main frame body;

a receiving space being formed and defined by said main frame body and said two side shells for depositing articles, whereby opening said movable shell of said main frame body to be an entrance of said receiving space;

a retractable handle disposed in a top of said fixed shell of said main frame body; and two wheels pivoted to a bottom of said fixed shell of said main frame body.

2. The wheeled luggage as defined in claim 1, wherein each of said side shells has a portion of an end edge being fastened with said fixed shell of said main frame body, and other portion of the end edge being detachably fastened with said movable shell of said main frame body.

3. The wheeled luggage as defined in claim 2, further comprising at least one zipper which is disposed at a juncture of said movable shell, said fixed shell, and said side shells.

4. The wheeled luggage as defined in claim 1, wherein each of said side shells comprises a shell piece body having an elasticity, and a cloth body having a softness, said shell piece body being provided with at least one opening, said cloth body being disposed in an inner side of said shell piece body.

5. The wheeled luggage as defined in claim 1, wherein said movable shell of said main frame body comprises a first shell piece and a second shell piece, said two shell bodies being pivoted to each other.

6. The wheeled luggage as defined in claim 5, wherein said first shell piece and said second shell piece of said movable shell are integrally made and are provided with a bending portion located at a juncture of said first shell piece and said second shell piece, said bending portion enabling said first shell piece and said second shell piece to turn in a predetermined angular range.

7. The wheeled luggage as defined in claim 1 further comprising at least one carrying belt to facilitate the carrying of the wheeled luggage on the back of a person.

8. The wheeled luggage as defined in claim 7, wherein said carrying belt comprises a main strap body, two connection belts, and four retaining seats, with two of said four retaining seats being disposed in a top of said main frame body, and with other two of said four retaining seats being disposed in a bottom of said main frame body, said two connection belts being disposed respectively at two ends on two retaining seats which are located on the same side, said main strap body being pivoted at two ends thereof to said two connection belts.

9. The wheeled luggage as defined in claim 1, wherein said retractable handle comprises an expandable member and a handlebar which is disposed at an outer end of said expandable member, said expandable member being a long strip body having an elasticity, said expandable member being pivoted to an inner side of said fixed shell, said handlebar being located in an outer side of said fixed shell.

10. The wheeled luggage as defined in claim 1, wherein said two side shells are detachably joined with said main frame body.

* * * * *